US005930867A

United States Patent [19]

Grzeskowiak

[11] Patent Number: 5,930,867

[45] Date of Patent: Aug. 3, 1999

[54] DOOR HINGE

[75] Inventor: Hans Grzeskowiak, Braunstr. 12, 41836 Hueckelhoven, Germany

[73] Assignee: Hans Grzeskowiak, Hueckelhoven, Germany

[21] Appl. No.: 08/963,702

[22] Filed: Nov. 4, 1997

[51] Int. Cl.[6] ..... E05D 7/04; E05D 5/10

[52] U.S. Cl. ..... 16/244; 16/381; 16/386; 16/248

[58] Field of Search ..... 16/244, 243, 240, 16/380, 381, 386, 248

[56] References Cited

U.S. PATENT DOCUMENTS

| | | | |
|---|---|---|---|
| 1,103,607 | 7/1914 | Moore | 16/255 |
| 2,302,484 | 11/1942 | Werner | 16/244 |
| 2,611,921 | 9/1952 | Weidelstam | 16/244 |
| 5,568,673 | 10/1996 | Ryczek | 16/244 |

FOREIGN PATENT DOCUMENTS

| | | | |
|---|---|---|---|
| 1007855 | 2/1952 | France | 16/244 |
| 329876 | 12/1920 | Germany | 16/244 |
| 812652 | 9/1951 | Germany | 16/244 |
| 1277072 | 9/1968 | Germany | 16/382 |
| 383202 | 12/1964 | Switzerland | 16/381 |

*Primary Examiner*—Chuck Y. Mah
*Attorney, Agent, or Firm*—Michael A. Glenn

[57] ABSTRACT

According to the invention there is provided a door fitting comprising a travelling door fitting member; a stationary door fitting member; a bolt extending between said travelling door fitting member and said stationary door fitting member and defining a swivelling axis around which said travelling door fitting member can swing around said stationary door fitting member; wherein said bolt has a first portion incorporated with a first door fitting member and a second portion incorporated with a second door fitting member, said first portion comprising a threaded portion for being threadedly engaged with said first door fitting member; wherein said threaded portion has a thread pitch of between 24 and 50 mm, preferably of between 36 and 46 mm, across an angle of 360°; and wherein said threaded portion comprises 5 to 7 threads.

14 Claims, 1 Drawing Sheet

DOOR HINGE

FIELD OF THE INVENTION

The present invention relates to a door fitting for accommodating a door.

BACKGROUND OF THE INVENTION

The German Patent application DE 195 41 346 discloses a door fitting comprising a travelling door fitting member, a stationary door fitting member and a bolt extending between said travelling door fitting member and said stationary door fitting member. The bolt defines a swelling axis around which said travelling door fitting member can swing about said stationary door fitting member. The door fitting according to the above mentioned German Patent application, which was filed on behalf of the applicant of the present invention, furthermore discloses a bolt having a first portion being in cooperation with a first door fitting member, said first portion comprising a threaded portion for being threadedly engaged with a first of said door fitting members. As the bolt is threadedly engaged with a door fitting member, a door which is held by the door fitting will raise upon opening. Therefore, a door is not likely to strike any obstacles on the ground during opening. The DE-A-195 41 346 discloses a thread pitch of 15 mm across an opening angle of the door of 90°.

The German Patent No. 22 784, issued to Duisberg in the year 1882, discloses a door fitting comprising a travelling door fitting member, a stationary door fitting member and a bolt extending between the door fitting members. The bolt has a first portion being threadedly engaged with a first of said door fitting members. According to the disclosure of this prior document, the door will raise between 5 to 7 mm across an angle of rotation of the door of 90°. This door fitting is not capable to accommodate heavy doors.

It is an object of the present invention, to provide an improved door fitting, which allows raising of the door upon opening of the door. It is another object of the present invention, to provide an improved door fitting, which allows self acting closing of the door without jamming of the door. It is furthermore an object of the present invention, to provide a door fitting, which can accommodate heavy doors, particularly glass doors.

SUMMARY OF THE INVENTION

According to the invention there is provided a door fitting comprising a travelling door fitting member; a stationary door fitting member; a bolt extending between said travelling door fitting member and said stationary door fitting member and defining a swivelling axis around which said travelling door fitting member can swing around said stationary door fitting member; wherein said bolt has a first portion incorporated with a first door fitting member and a second portion incorporated with a second door fitting member, said first portion comprising a threaded portion for being threadedly engaged with said first door fitting member; wherein said threaded portion has a thread pitch of between 24 and 50 mm, preferably of between 36 and 46 mm, across an angle of 360°; and wherein said threaded portion comprises 5 to 7 threads.

As the door fitting according to the present invention has a thread pitch of between 24 and 50 mm, preferably of between 36 and 46 mm, across an angle of rotation of 360°, each door accommodated by the inventive door fitting will close in a self acting fashion. The applicant has conducted experiments showing that irrespective the weight of the respective door, the friction will be to high for a door to close automatically with a threaded portion having a thread pitch of less than 24 mm across an angle of rotation 360°. A thread pitch of more than 50 mm leads to a jamming of the door. These experiments were conducted with a threaded portion of the bolt having between 5 and 7 threads for being capable of accommodating heavy doors, particularly glass doors.

In another aspect of the invention there is provided a door fitting comprising a travelling door fitting member; a stationary door fitting member; a bolt extending between said travelling door fitting member and said stationary door fitting member and defining a swivelling axis around which said travelling door fitting member can swing around said stationary door fitting member; wherein said bolt has a first portion incorporated with a first door fitting member and a second portion incorporated with a second door fitting member, said first portion comprising a threaded portion for being threadedly engaged with said first door fitting member; and wherein a face surface of said second bolt portion comprises an internal screw thread for accommodating a fastening screw, said internal screw thread having the same direction of rotation as said threaded portion of said door fitting member.

The fastening screw secures the bolt to the second door fitting member and prevents the bolt from rotating upon opening of the door. The fastening screw can be removed in order to change the door fitting into a standard door fitting without a raising effect upon opening of a door. When the fastening screw is removed or attached to the first bolt portion, the second bolt portion will swing relative to the second door fitting member, whereas there will be no relative movement of the first door fitting member and the first portion of the bolt. Therefore, the provision of a fastening screw and a corresponding internal screw thread at the face surface of the second bolt portion leads to a multifunctional door fitting, which can be used either as a standard door fitting or as a raising door fitting, i.e. as a door fitting, which leads to an elevating of the door upon opening. The inventor of the present invention has discovered, that the fastening screw will never loosen even after 105 alternations of load with an internal screw thread having the same direction of rotation as the threaded portion of the door fitting member.

In third aspect of the present invention, there is provided a door fitting comprising a travelling door fitting member; a stationary door fitting member; a bolt extending between said travelling door fitting member and said stationary door fitting member and defining a swivelling axis around which said travelling door fitting member can swing around said stationary door fitting member; wherein said bolt has a first portion incorporated with a first door fitting member and a second portion incorporated with a second door fitting member, said first portion comprising a threaded portion for being threadedly engaged with said first door fitting member; and wherein the flanks of each threaded tooth of said threaded portion converge towards a face surface of said bolt portion.

The flanks of each threaded tooth of the threaded portion converting towards a face surface of said bolt portion facilitates assembling of the door fitting. Usually the door fitting is assembled with the travelling door fitting being fixed to the door and the stationary door fitting being fixed to the door frame. The door has to be adjusted with at least two door fittings matching on the respective bolts. The door has to be lifted to bring the bolt incorporated with a door fitting member. As the inventive door fitting comprises a threaded portion having flanks of each threaded tooth converting towards a face surface, the area preventing the sliding of a door fitting member on the threaded portion of the bolt is reduced. Assembling the door fitting can be further facilitated with the respective door fitting member comprising a thread which is designed in accordance with the threaded portion of the first portion of the bolt is facilitated.

BRIEF DESCRIPTION OF THE DRAWINGS

The novel features believed to characterise the invention are set forth in the appended claims. The invention itself, however, as well as other features and advantages thereof, will be best understood by reference to the detailed description which follows, read in conjunction with the accompanying drawings, wherein:

DETAILED DESCRIPTION WITH REFERENCE TO THE DRAWINGS

Figure 1:
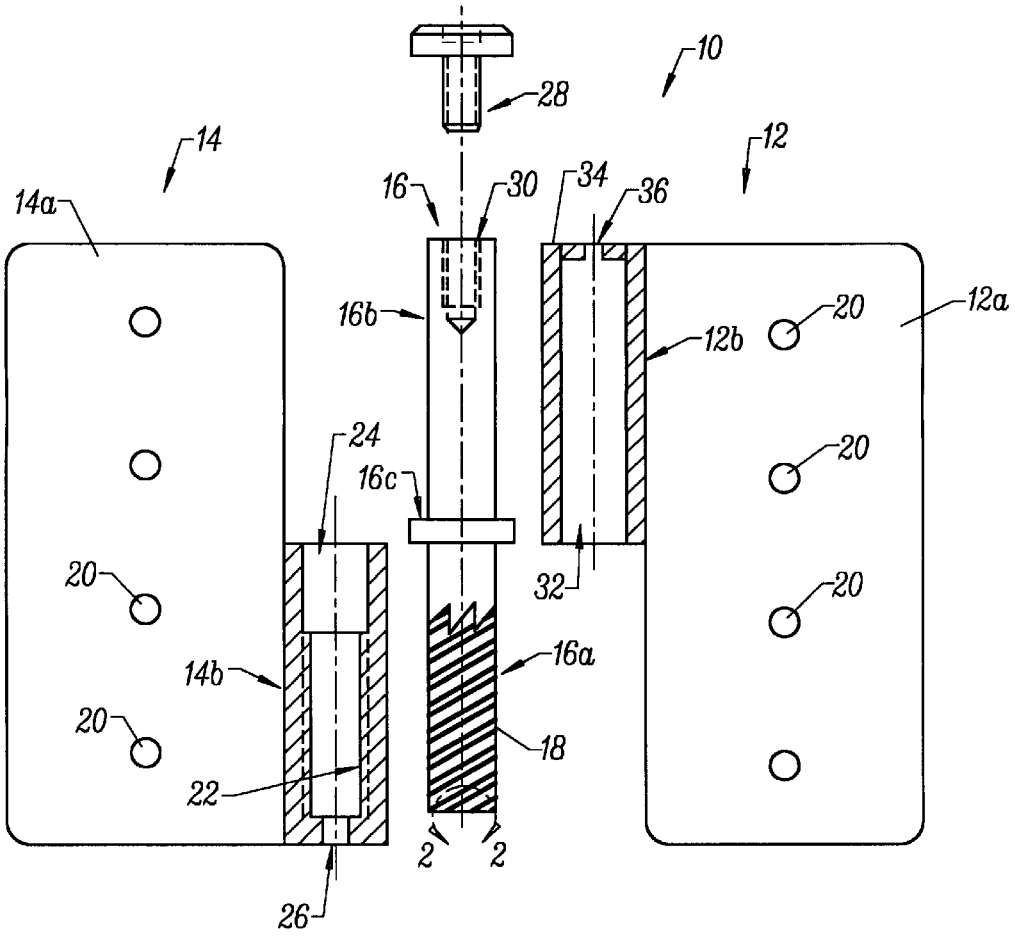
FIG. 1 is an end view of a door fitting.

Referring to FIG. 1, the door fitting 10 comprises a travelling door fitting member 12 and a stationary door fitting member 14. The travelling door fitting member 12 is designed to be attached to a door and the stationary door fitting member 14 is designed to be attached to a door frame. Furthermore the door fitting 10 comprises a bolt 16. For the sake of clarity, the bolt 16 has not been shown in FIG. 1 incorporated with either door fitting members 12 and 14.

The bolt 16 comprises a first portion 16*a* and a second portion 16*b*. Between the first portion 16*a* and the second portion 16*b*, there is provided a flange 16*c*. The first portion 16*a* of the bolt 16 comprises a threaded portion 18. This threaded portion 18 has a thread pitch of between 36 and 46 mm across an angle of 360°. In order to reduce the pressure on the flanks of the thread generated by a door to be accommodated by the door fitting 10, the threaded portion 18 has 6 threads.

The stationary door fitting member 14 comprises an attachment means 14*a* and a bolt accommodating means 14*b*. In the present embodiment the attachment means 14*a* comprises holes 20 for connecting the stationary door fitting member 14 by means of screws (not shown) with a door (not shown). The bolt accommodating means 14*b* is cylindrical and comprises an internal screw thread 22. Between the internal screw thread 22 and the end face adjacent to the travelling door fitting member 12 there is provided a bore 24 in the bolt accommodating means 14*b*. The bore 24 has a larger inner diameter than the internal screw thread 22. The end face of the cylindrical bolt accommodating means 14*b* opposite the travelling door fitting member 12 comprises a bore 26 for accommodating a fastening screw 28.

The bolt 16 of the embodiment shown in FIG. 1 comprises an internal screw 30 provided at each face surface of the bolt 16 and extending parallel to the center axis thereof. (The internal screw at the face surface of the first portion 16*a* of the bolt 16 is not shown). The outer diameter of the flange 16*c* is essentially equal to the outer diameter of the bolt accommodating means 14*b* of the stationary door fitting member 14 and a respective bolt accommodating means 12*b* of the travelling door fitting member 12. This bolt accommodating means 12*b* is attached to an attachment member 12*a*, which is formed in an identical way as the respective attachment member 14*a* of the stationary door fitting member 14 for fixing the former to a door frame.

The bolt accommodating means 12*b* comprises a central bore 32 with an inner diameter suitable for accommodating the cylindrical portion 16*b* of the bolt 16. At the end face of the central bore 32 opposite the of the stationary door fitting member 14 there are provided projections 34 projecting radially inwardly into the bore 32 and leaving therebetween a fastening screw accommodating bore 36 for accommodating the fastening screw 28.

For assembling the embodiment as shown in FIG. 1, the travelling door fitting member 12 will be attached to a door, whereas the stationary door fitting member 14 will be attached to a door frame. Then the bolt 16 is inserted into the bore 24 of the bolt accommodating means 14*a* for bringing the treaded portion 18 of the first bolt portion 16*a* in engagement with the internal screw thread 22. After this, the door is lifted in order to place the bolt accommodating means 12*b* above the second portion 16*b* of the bolt 16 and axially aligned with the bolt 16. Lowering the door the second bolt portion 16*b* will slide into the bore 32.

In order to make the door raise upon opening thereof, the fastening screw 28 is inserted into the fastening screw accommodating bore 36 and tightened against the second portion 16*b* of the bolt 16 by means of the internal screw 30. This will be done with the door closed. As the fastening screw 28 prevents the bolt 16 from rotating around the bolt accommodating means 12*b* of the travelling door fitting member 12, the bolt 16 will rotate around the bolt accommodating means 14*b* of the stationary door fitting member 14 upon opening. Therefore the door will raise upon opening of the door.

Figure 2:
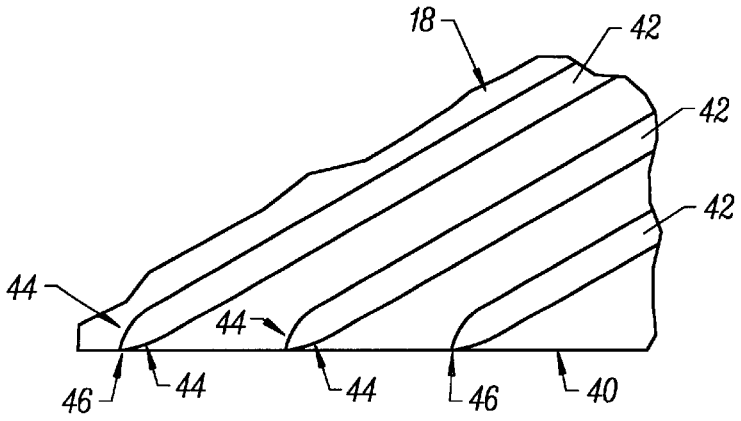
FIG. 2 is an enlarged view of the circled part A of FIG. 1.

Reference is made to FIG. 2, which shows an enlarged portion of the threaded portion 18 of the bolt 16. Adjacent the end face 40 of the threaded portion 18 each threaded tooth 42 of the threaded portion 18 has converging flanges 44. The flanges therefore form a linear connecting surface 46 which is a part of the end surface of the bolt of the shown embodiment. This facilitates reassembling of the door once the bolt 16 is secured to the bolt accommodating means 12*b*.

It should be noted that the door fitting members 12, 14 can be attached adverse to the above described way. This might be beneficial especially for the upper door fitting member of a door in order to facilitate fastening of the fastening screw 28 without a ladder. In this case the door will be lowered onto the threaded portion 18 of the first portion 16*a* of the bolt 16 for assembling. This will be facilitated by the flanks of the threaded portion 18 converging toward each other towards the end surface of the bolt 16. The assembling can be further facilitated by designing the internal thread screw 22 of the bolt accommodating means 14*b* in accordance with the above described design of the treaded portion 18.

Accordingly, while this invention has been describes with reference to illustrative embodiments, this description is not intended to be construed in a limiting sense. Various modifications of the illustrative embodiments, as well as other embodiments of the invention, will be apparent to a person skilled in the art upon reference to his description. It is therefore contemplated that the appended claims will cover any such modifications or embodiments as fall within the true scope of the invention.

I claim:

1. A door fitting comprising:

(a) a travelling door fitting member;

(b) a stationary door fitting member;

(c) a bolt extending between said travelling door fitting member and said stationary door fitting member and defining a swiveling axis around which said travelling door fitting member can swing around said stationary door fitting member;

(d) wherein said bolt has a first portion incorporated with a first door fitting member and a second portion incorporated with a second door fitting member, said first portion comprising a threaded portion for being threadedly engaged with said first door fitting member;

(e) wherein said threaded portion has a thread pitch of between 24 and 50 mm across an angle of 360°; and (f) wherein said threaded portion comprises 5 to 7 threads.

2. A door fitting according to claim 1, wherein a face surface of said second bolt portion comprises an internal screw thread for engagement with a fastening screw, said internal screw thread having the same direction of rotation as said threaded portion of said door fitting member.

3. A door fitting according to claim 1, wherein the flanks of each threaded tooth of said threaded portion converge towards an end face surface of said bolt portion.

4. A door fitting according to claim 3, wherein the flanks of each threaded tooth end towards the end face surface of said bolt portion to form a linear connecting surface which is a part of the end surface of the bolt.

5. A door fitting according to claim 4, wherein the linear connecting surface extends essentially parallel to said face surface.

6. A door fitting comprising:

(a) a travelling door fitting member;

(b) a stationary door fitting member;

(c) a bolt extending between said travelling door fitting member and said stationary door fitting member and defining a swiveling axis around which said travelling door fitting member can swing around said stationary door fitting member;

(d) wherein said bolt has a first portion incorporated with a first door fitting member and a second portion incorporated with a second door fitting member, said first portion comprising a threaded portion for being threadedly engaged with said first door fitting member; and (e) wherein a face surface of said second bolt portion comprises an internal screw thread for engagement with a fastening screw, said internal screw thread having the same direction of rotation as said threaded portion of said door fitting member, wherein said threaded portion has a thread pitch of between 24 and 50 mm across an angle of 360°; and wherein said threaded portion comprises 5 to 7 threads.

7. A door fitting according to claim 6, wherein the flanks of each threaded tooth of said threaded portion converge towards an end face surface of said bolt portion.

8. A door fitting according to claim 6, wherein the flanks of each threaded tooth end towards the end face surface of said bolt portion to form a linear connecting surface, which is a part of the end surface of the bolt.

9. A door fitting according to claim 8, wherein the linear connecting surface extends essentially parallel to said face surface.

10. A door fitting comprising:

(a) a travelling door fitting member;

(b) a stationary door fitting member;

(c) a bolt extending between said travelling door fitting member and said stationary door fitting member and defining a swiveling axis around which said travelling door fitting member can swing around said stationary door fitting member;

(d) wherein said bolt has a first portion incorporated with a first door fitting member and a second portion incorporated with a second door fitting member, said first portion comprising a threaded portion for being threadedly engaged with said first door fitting member; and (e) wherein the flanks of each threaded tooth of said threaded portion converge towards an end face surface of said bolt portion.

11. A door fitting according to claim 10, wherein the flanks of each threaded tooth end towards the face surface of said bolt portion to form a linear connecting surface, which is a part of the end surface of the bolt.

12. A door fitting according to claim 11, wherein the linear connecting surface extends essentially parallel to said face surface.

13. A door fitting according to claim 11, wherein said threaded portion has a thread pitch of between 24 and 50 mm across an angle of 360°; and wherein said threaded portion comprises 5 to 7 threads.

14. A door fitting according to claim 11, wherein a face surface of said second bolt portion comprises an internal screw thread for engagement with a fastening screw, said internal screw thread having the same direction of rotation as said threaded portion of said door fitting member.

* * * * *